US011879663B2

(12) United States Patent
Green

(10) Patent No.: US 11,879,663 B2
(45) Date of Patent: Jan. 23, 2024

(54) HVAC CONDENSATE EVAPORATION AND AEROBIC DISPERSION SYSTEMS

(71) Applicant: ETR LLC, Tyler, TX (US)

(72) Inventor: Todd Green, Tyler, TX (US)

(73) Assignee: ETR LLC, Tyler, TX (US)

( * ) Notice: Subject to any disclaimer, the term of this patent is extended or adjusted under 35 U.S.C. 154(b) by 341 days.

(21) Appl. No.: 17/010,385

(22) Filed: Sep. 2, 2020

(65) Prior Publication Data

US 2021/0063047 A1 Mar. 4, 2021

Related U.S. Application Data

(60) Provisional application No. 62/895,147, filed on Sep. 3, 2019.

(51) Int. Cl.
*F24F 13/20* (2006.01)
*F24F 13/22* (2006.01)

(52) U.S. Cl.
CPC ..... *F24F 13/222* (2013.01); *F24F 2013/225* (2013.01); *F24F 2013/228* (2013.01); *F24F 2221/34* (2013.01)

(58) Field of Classification Search
CPC ..... F24F 13/222
See application file for complete search history.

(56) References Cited

U.S. PATENT DOCUMENTS

| | | | | |
|---|---|---|---|---|
| 2,794,624 | A | 6/1957 | Campagna et al. | |
| 5,126,080 | A | 6/1992 | Morton et al. | |
| 5,543,090 | A | 8/1996 | Morton et al. | |
| 9,416,997 | B1 * | 8/2016 | Bush, Jr. | F24F 1/022 |
| 9,631,833 | B2 * | 4/2017 | Arensmeier | F24F 13/222 |
| 9,741,023 | B2 | 8/2017 | Arensmeier et al. | |
| 9,920,963 | B1 * | 3/2018 | Rafalovich | F25B 13/00 |
| 10,274,945 | B2 | 4/2019 | Arensmeier et al. | |
| 10,982,874 | B2 * | 4/2021 | Ryu | F24F 3/147 |
| 11,162,739 | B2 * | 11/2021 | Ryu | F24F 5/0035 |
| 11,287,166 | B2 * | 3/2022 | Mohammad | F28C 1/14 |
| 2002/0083728 | A1 * | 7/2002 | Lee | F24F 13/222 62/280 |

(Continued)

FOREIGN PATENT DOCUMENTS

CN 102121566 B 7/2011

*Primary Examiner* — Filip Zec
(74) *Attorney, Agent, or Firm* — Kirby Drake

(57) ABSTRACT

An HVAC condensate evaporation system or aerobic dispersion system may transform the condensate that drains out of HVAC systems and/or septic systems into steam that is less likely to cause property damage. The system may be installed midstream in a condensate line and condensate that flows through the condensate line in normal operation may enter the chamber where it hits a solar-powered boiler that evaporates the condensate back into the atmosphere as steam. By converting the condensate into steam, property damage due to drainage out of the condensate line of an HVAC system may be minimized, or even eliminated. The system also may include a back-up capacitor or battery for low solar days. The system may further include wireless notification capability, including, but not limited to, Wi-Fi capability, to transmit notifications to the building owner or other interested parties of condensate issues as they may arise.

10 Claims, 2 Drawing Sheets

(56) References Cited

U.S. PATENT DOCUMENTS

| | | | | |
|---|---|---|---|---|
| 2004/0250841 | A1* | 12/2004 | Kimbrough | B08B 3/04 134/115 R |
| 2007/0107450 | A1* | 5/2007 | Sasao | F24F 11/63 62/185 |
| 2008/0072614 | A1* | 3/2008 | Bhatti | F28B 1/06 62/305 |
| 2008/0173723 | A1 | 7/2008 | Zhadanovsky | |
| 2014/0203459 | A1 | 7/2014 | Kopel et al. | |
| 2014/0352344 | A1* | 12/2014 | Guercio | F24F 13/222 62/499 |
| 2015/0115053 | A1 | 4/2015 | Kopel et al. | |
| 2017/0108233 | A1* | 4/2017 | Howard | F24S 10/742 |
| 2017/0157527 | A1 | 6/2017 | Kopel et al. | |
| 2019/0128561 | A1* | 5/2019 | Hernandez | F24F 13/222 |
| 2019/0242595 | A1* | 8/2019 | Eplee | F24F 13/30 |

* cited by examiner

HVAC CONDENSATE EVAPORATION AND AEROBIC DISPERSION SYSTEMS

CROSS-REFERENCE TO RELATED APPLICATION

The present application is a non-provisional of, and claims the benefit of priority to, U.S. Patent Application No. 62/895,147, filed Sep. 3, 2019, the disclosure of which is incorporated by reference herein in its entirety.

FIELD OF THE DISCLOSURE

The present disclosure generally relates to HVAC and septic systems, and more particularly to HVAC condensate evaporation and aerobic dispersion systems.

BACKGROUND

Heating, ventilation, and cooling (HVAC) systems include a condensate line that drains excess moisture outside of the place that it is cooling, such as a home or business. The condensate is a byproduct of the cooling cycle. This condensate line is particularly important when used during cooling periods. As air is cooled using the HVAC system, humidity is absorbed which turns into condensation (or condensate). The condensate line connects to the HVAC unit and displaces the condensate away from the HVAC unit to an approved drain. The condensate line functions to keep moisture from building up inside the HVAC unit; however, when the condensate is funneled outdoors away from the HVAC unit, the condensate typically ends up in sewers, condensate pits, and/or other places that may not be up to code. Similar issues can arise with treated water from an aerobic septic system. Further, issues can arise with a condensate line when it is clogged by mold, mildew, dust, dirt, and other contaminants that may be built up on the HVAC evaporator coil. Given the remote location of the HVAC system, it is sometimes difficult to know when clogs occur as most clogs surface within the walls or midstream, out of sight.

SUMMARY

Embodiments of the present disclosure may provide an HVAC condensate evaporation system or aerobic-treated water dispersion system that may transform the condensate that drains out of HVAC systems and/or septic systems into steam that is less likely to cause property damage and add relief to municipal water treatment centers. The system according to embodiments of the present disclosure may be installed midstream in a condensate line, and condensate that flows through the condensate line in normal operation may enter the chamber where it hits a solar-powered boiler that evaporates the condensate back into the atmosphere as steam. By converting the condensate into steam, property damage due to drainage out of the condensate line of an HVAC system may be minimized, or even eliminated. The system according to embodiments of the present disclosure also may include a back-up capacitor or battery for low solar days. In embodiments of the present disclosure, the system may further include wireless notification capability, including, but not limited to, Wi-Fi capability, to transmit notifications to the building owner or other interested parties of condensate issues as they may arise.

Embodiments of the present disclosure may provide a heating, ventilation, and air conditioning (HVAC) condensate evaporation system comprising: a water chamber; at least one evaporation vent positioned above the water chamber; a wiring conduit chamber extending vertically from the at least one evaporation vent down one side of the water chamber; and a steam generator placed within and enclosed by the water chamber that evaporates condensate, wherein the system is installed midstream in a condensate line. The system also may include one or more solar panels positioned above the at least one evaporation vent; and solar panel electronics positioned directly below the one or more solar panels. The wiring conduit chamber may house one or more batteries to power the system on low solar days. The system may further include a supplemental battery holder that extends horizontally along a base of the water chamber. The system also may include a washable, removable screen provided in the water chamber above a discharge line, wherein the screen may trap debris present in the condensate. The system may include a unit attached below the water chamber that is communication with the wiring conduit chamber that houses mechanics for operation of the steam generator. The mechanics also may include wireless components that provide wireless notifications to a user when condensate issues arise. The wireless components may be powered by solar energy and may include Wi-Fi or Bluetooth technology. The system may further include a first drain provided in an upper portion of the water chamber, wherein the first drain may provide drainage for a rooftop unit (RTU) or an indoor HVAC system and a second drain provided in a lower portion of the water chamber, wherein the second drain may provide drainage to a P trip or a primary drain line. The system also may include one or more legs affixed to a bottom of the water chamber, wherein the one or more legs may provide for positioning and adjustment of the system.

Other embodiments of the present disclosure may provide an aerobic dispersion system comprising: a box having sides formed of a perforated material that provides for removal of steam from the box, the box further comprising: a water shed cover; a steam heat pipe positioned horizontally along an inside of the box; a treated water inlet piping provided in an upper portion of the box to receive water into the box; and a drain tube that may extend out of a lower portion of the box to provide drainage away from the steam heat pipe. The system may also include one or more solar panels external to the box. The system may include an electric heater that includes a thermostat or controller, and the electric heater may be mounted external to the box. The system also may include a battery pack that may power the system in addition to or in place of one or more solar panels. The system may further include a hinged access door and/or one or more legs affixed to a bottom of the box, wherein the one or more legs may provide for positioning and adjustment of the system.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide a heating, ventilation, and cooling (HVAC) condensate evaporation system that minimizes the condensate that drains out of HVAC systems that typically has flowed into sewers, condensate pits, and/or other places that may not be up to code. Many consumers may not even be aware of the condensate until it causes property damage, such as flooding an attic or damaging a ceiling. Thus, as described in more detail below, using an HVAC condensate evaporation system according to embodiments of the present disclosure may transform the condensate into steam that is less likely to cause damage.

The system according to embodiments of the present disclosure may be installed midstream in an HVAC condensate line and may include a small chamber with a solar-powered boiler that may turn the condensate into steam. Condensate that flows through the HVAC condensate line in normal operation may enter the chamber where it hits a solar-powered boiler that evaporates the condensate back into the atmosphere as steam. By converting the condensate into steam, this keeps the condensate out of sewers, condensate pits, and even off rooftops and gutters. Accordingly, property damage due to drainage out of the condensate line of an HVAC system may be minimized, or even eliminated using an HVAC condensate evaporation system according to embodiments of the present disclosure.

The HVAC condensate evaporation system according to embodiments of the present disclosure utilizes solar power but also may include a back-up capacitor or battery for low solar days. The system may further include wireless notification capability, including, but not limited to, Wi-Fi capability, to transmit notifications to the building owner or other interested parties of condensate issues as they may arise. In some embodiments of the present disclosure, the HVAC condensate evaporation system may be integrated or may interface with existing Wi-Fi, Bluetooth, or other wireless-enabled home/business systems to notify users when condensate is an issue with the HVAC system. While such integration/interfacing may be provided, it also should be appreciated that there may be embodiments of the present disclosure where the HVAC condensate evaporation system may operate and provide notifications on a standalone basis. In some embodiments of the present disclosure, the HVAC condensate evaporation system may be installed as part of rooftop units in commercial environments; however, there may be other embodiments of the present disclosure where the HVAC condensate evaporation system may be utilized in residential systems, such as residential roof-mounted systems.

Figure 1:
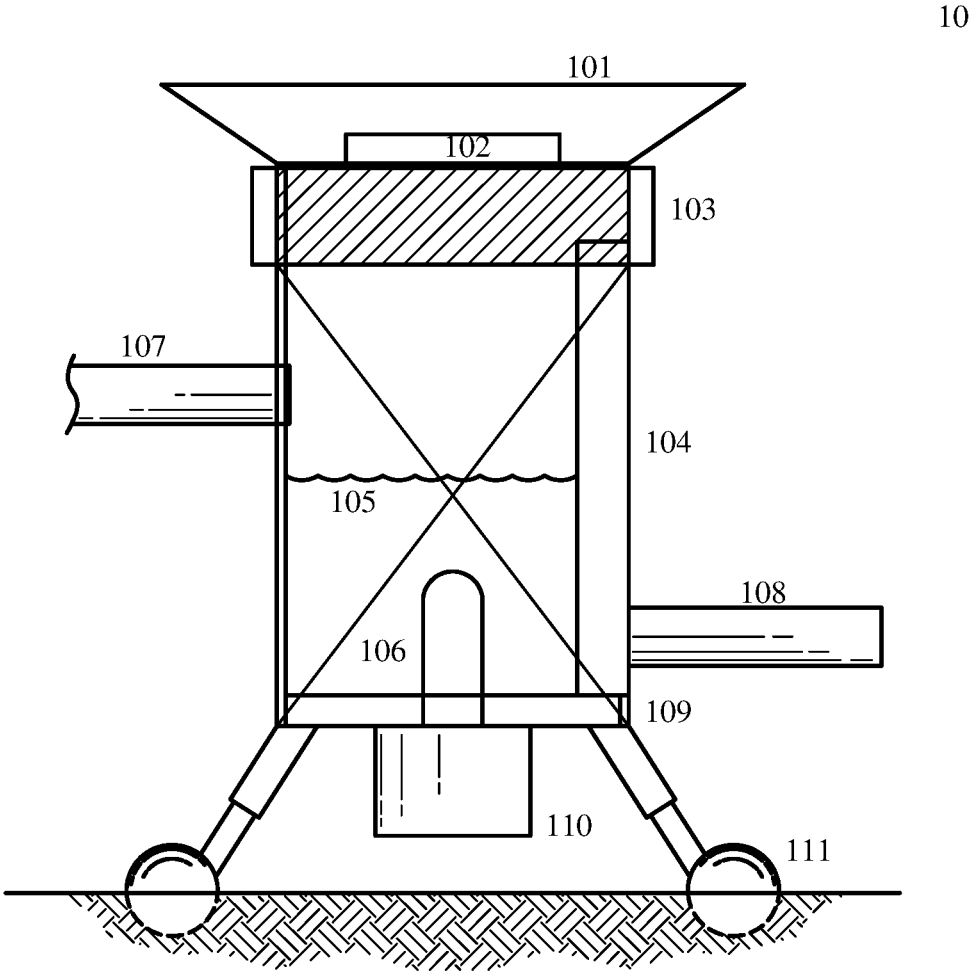
FIG. 1 depicts an HVAC condensate evaporation system according to an embodiment of the present disclosure.

FIG. 1 depicts HVAC condensate evaporation system 10 according to an embodiment of the present disclosure. System 10 may include one or more solar panels 101 positioned on the top of system 10. One or more solar panels 101 may be operated through solar panel electronics 102 which may be positioned directly below one or more solar panels 101 in an embodiment of the present disclosure. System 10 may include evaporation vents 103 above water chamber 105 with wiring conduit chamber 104 extending vertically along the side of water chamber 105 from evaporation vents 103 down to wiring conduit chamber and supplemental battery holder 109 that may extend horizontally along the base of water chamber 105. In some embodiments of the present disclosure, a screen may be provided in water chamber 105 above the discharge line. This may be washable and/or removable in embodiments of the present disclosure, and it may trap debris that may be present in the condensate. Wiring conduit chamber and supplemental battery holder 109 may include one or more batteries that may be utilized on low solar days when one or more solar panels 101 may not generate enough energy to sufficiently operate system 10. Steam generator 106 may be placed within and enclosed by water chamber 105 with wiring conduit chamber and supplemental battery holder 109 running below steam generator 106. Mechanics 110 may be placed in a unit that is integrated with and extends below wiring conduit chamber and supplemental battery holder 109. Mechanics 110 may include, but are not limited to, mechanics for operation of steam generator 106 and wireless components, such as Wi-Fi or Bluetooth, to provide notifications if condensate issues arise, as previously described. It should be appreciated that the wireless components may be powered by solar energy in some embodiments of the present disclosure; however, there may be embodiments of the present disclosure where the system may include a battery backup that may be used to power the wireless components on low solar days. Drain 107 may be provided in an upper portion of water chamber 105 and provide drainage for a rooftop unit (RTU) or indoor HVAC system in embodiments of the present disclosure. Drain 108 may be provided in a lower portion of water chamber 105 and provide drainage to a P trap or primary drain line in embodiments of the present disclosure. Legs 110 may be provided on the bottom of system 10 that may provide for easy positioning and adjustment of system 10 in embodiments of the present disclosure.

Figure 2:
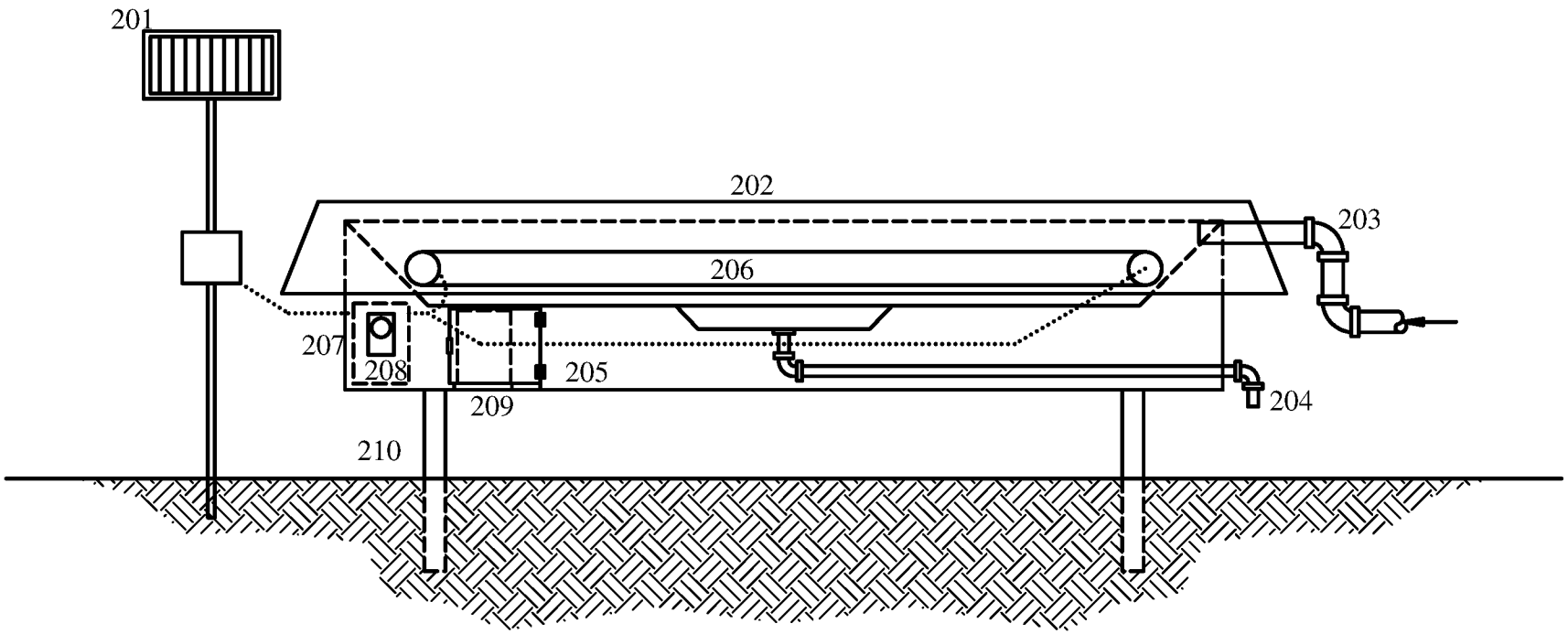
FIG. 2 depicts an aerobic dispersion system according to an embodiment of the present disclosure.

FIG. 2 depicts aerobic dispersion system 20 according to an embodiment of the present disclosure. Like HVAC condensate evaporation system 10 of FIG. 1, aerobic dispersion system 20 may include one or more solar panels 201. One or more solar panels 201 may be exterior to other portions of system 20, such as depicted in FIG. 2; however, there may be other embodiments of the present disclosure where one or more solar panels may be in a different position or may be more integrated with the other portions of system 20. Box 211 may include water shed cover 202 and the sides of box 211 may be constructed of a perforated material to allow easier removal of steam from box 211 in embodiments of the present disclosure. Box 211 may include steam heat pipe 206 positioned horizontally along the inside of box 211. Treated water inlet piping 203 may be provided in an upper portion of box 211 to receive water into box 211 and drain tube 204 may extend out of a lower portion of box 211 and provide drainage away from steam heat pipe 206 in an embodiment of the present disclosure. Box 211 may include electric heater 207 which may include thermostat or controller 208, which may be externally mounted in embodiments of the present disclosure. Battery pack 209 may be provided to power system 20 on a low-solar day or when one or more solar panels 201 may not be operating well. System 20 also may include hinged access door 205 to access one or more items of system 20 such as battery pack 209 in embodiments of the present disclosure. System 20 may further include legs 210 that may be provided on the bottom of system 20 to allow for easy positioning and adjustment of system 20 in embodiments of the present disclosure.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A heating, ventilation, and air conditioning (HVAC) condensate evaporation system installed outside midstream in a condensate line comprising:

a water holding and evaporation chamber;

at least one evaporation vent positioned above the water holding and evaporation chamber;

a wiring conduit chamber extending vertically from the at least one evaporation vent down one side of the water chamber;

a first condensate inlet provided in an upper portion of the water holding and evaporation chamber, wherein the first condensate inlet receives condensate drainage from a drain pan outlet of a rooftop unit (RTU) or an indoor HVAC system;

a steam generator placed within and enclosed by the water holding and evaporation chamber that evaporates condensate;

at least one or more solar panels positioned above the at least one evaporation vent, wherein the at least one or more solar panels fully power the steam generator to evaporate the condensate into the atmosphere as steam and the first condensate inlet provides a backup to the at least one or more solar panels for drainage of the condensate on low solar days when the steam generator is bypassed; and solar panel electronics positioned directly below the at least one or more solar panels, wherein the solar panel electronics provide wireless notifications to a user when condensate issues arise.

2. The HVAC condensate evaporation system of claim 1, wherein the wiring conduit chamber houses at least one or more batteries to power the system on low solar days.

3. The HVAC condensate evaporation system of claim 1 further comprising:

a supplemental battery holder that extends horizontally along a base of the water chamber.

4. The HVAC condensate evaporation system of claim 1 further comprising:

a washable, removable screen provided in the water chamber above a discharge line, wherein the screen traps debris present in the condensate.

5. The HVAC condensate evaporation system of claim 1 further comprising:

a unit attached below the water chamber that is communication with the wiring conduit chamber that houses mechanics for operation of the steam generator.

6. The HVAC condensate evaporation system of claim 5, the mechanics further comprising:

wireless components that provide wireless notifications to a user when condensate issues arise.

7. The HVAC condensate evaporation system of claim 6, wherein the wireless components are powered by solar energy.

8. The HVAC condensate evaporation system of claim 6, wherein the wireless components include Wi-Fi or Bluetooth technology.

9. The HVAC condensate evaporation system of claim 1 further comprising:

a second drain provided in a lower portion of the water chamber, wherein the second drain provides drainage to a P trip or a primary drain line.

10. The HVAC condensate evaporation system of claim 1 further comprising:

at least one or more legs affixed to a bottom of the water chamber, wherein the lat least one or more legs provide for positioning and adjustment of the system.

* * * * *